US005316312A

United States Patent [19]

Dudley

[11] Patent Number: 5,316,312

[45] Date of Patent: May 31, 1994

[54] AIRBORN ARCHERY TARGET

[76] Inventor: Jerome M. Dudley, 210 N. Pleasant Ave., Galesburg, Ill. 61401

[21] Appl. No.: 69,207

[22] Filed: Jun. 1, 1993

[51] Int. Cl.[5] ..... F41J 3/00; F41J 9/08

[52] U.S. Cl. ..... 273/362; 273/365

[58] Field of Search ..... 273/362, 363, 364, 365

[56] References Cited

U.S. PATENT DOCUMENTS

| | | | |
|---|---|---|---|
| 2,481,507 | 9/1949 | Goldstein | 273/362 |
| 2,744,356 | 5/1956 | Killinger et al. | 273/363 |
| 3,139,700 | 7/1964 | Wyrick | 273/362 X |
| 3,185,480 | 5/1965 | Weyman et al. | 273/365 |
| 3,359,000 | 12/1967 | Schreiber | 273/365 |
| 5,098,109 | 3/1992 | Wayne | 273/400 |

*Primary Examiner*—William H. Grieb

[57] ABSTRACT

A six sided double walled container housing having an open top and holding within the confines of those walls the canopy and lines of a parasail device therein and by four flexable fingers extending partly over the contents from the top perimeter of the four rigid foam perpendicular inner walls whose bonded exterior covering is a soft impact absorbing plastic foam material.

Target housing has a front and rear configuration showing a downwardly and rearwardly sloped triangular shaped front panel having a vent through which a stream of air enters to cause ejection of the parasail canopy which will support the target housing in flight. Base of the sloped triangular shaped front panel joins the matching perimeter of the bottom panel of the target housing to form an aerodynamic lift surface and the adjoining four perpendicular panel's matching perimeters joined to each other's matching perimeters are then joined to the matching perimeters of the bottom panel and those of the sloped triangular shaped front panel. Trailing ends of the parasail canopy support lines are secured to a loop extending up from the housing cavity bottom. Launch pin extending from near the lower rear corner of the target housing has a slot in and across its external diameter and its forend is imbedded in the rigid foam material forming the inner bottom panel of the target housing.

4 Claims, 1 Drawing Sheet

AIRBORN ARCHERY TARGET

DESCRIPTION

1. Technical Field

The invention relates to archery equipment and more particularly to a special purpose combination airborn archery target capable of being lofted skyward on a self braking launch vehical and deploying its own parasail device while disengaging from said launch vehical at a predetermined altitude and floating on the wind away from the archer thus presenting a moving target.

2. Background Art

Aerial archery targets in the prior art have been lofted skyward by hand or catapult and remained aloft only so long as their momentum allowed or were brought down by arrow impact.

It is the object of the invention to device a airborn archery target that is non-mechanical in construction and performance said airborn archery target being capable of deploying its own parasail device thus enabling said airborn archery target to be aloft for a time and distance dependant on altitude and wind speed.

Another object of the invention is to provide a target housing having a two ply construction featuring a rigid plastic foam interior surface around an open topped cavity. Bonded to the exterior of the rigid plastic foam cavity surfaces are six panels of suitable dimensions said panels cut from a soft plastic foam material said material capable of registering powdered chalk marks left by the impact of soft tipped self braking arrows and absorbing said impact with no noticable damage to said target housing.

DISCLOSURE OF THE INVENTION

The objects have been met by a airborn archery target comprized of six soft plastic foam panels joined together at their matching perimeters by being bonded to a rigid plastic foam liner surrounding an open topped cavity to form a housing container said housing container having a front and rear configuration for lofting purposes said cavity to house a plastic film parasail device held therein by four flexable fingers extending partly over said cavity from the top perimeters of the four perpendicular rigid foam walls of the housing cavity.

The front end of the target housing is comprized of a downwardly and rearwardly sloped triangular shaped panel said panel's base perimeter joined to that of the matching perimeter of the bottom panel while the apex of said triangular shaped panel joins the top foremost juncture of the adjacent forwardly angled perpendicular side panels and the hypotenuse perimeters of the triangular shaped panel join the matching perimeters of said adjacent forwardly angled side panels thus presenting an aerodynamic lift surface. A vent through the walls of the triangular shaped front panel into the cavity of the housing provides access for a stream of air to cause ejection of the parasail device from the housing cavity. Extending from the rearward juncture of the rearwardly angled perpendicular side panels and near the rear bottom corner of the housing is a launch pin said launch pin having a slot in and across its exposed diameter while its forend is imbedded in the rigid foam material forming the bottom of said cavity. The parasail canopy support lines are secured to a loop attached to the housing cavity's bottom.

BEST MODE FOR CARRYING OUT THE INVENTION

Figure 1:
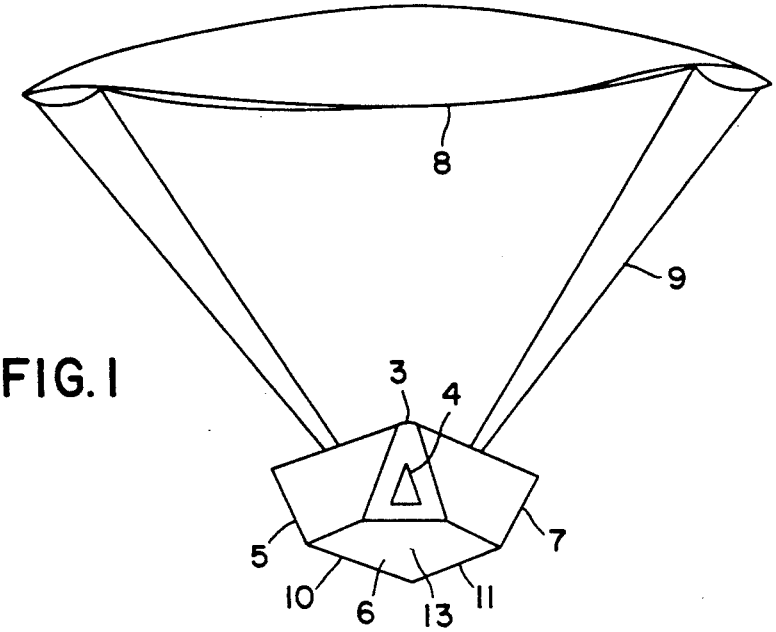
FIG. 1 is a combined front and bottom view of the target housing suspended by four support lines from the canopy of the parasail.
Figure 2:
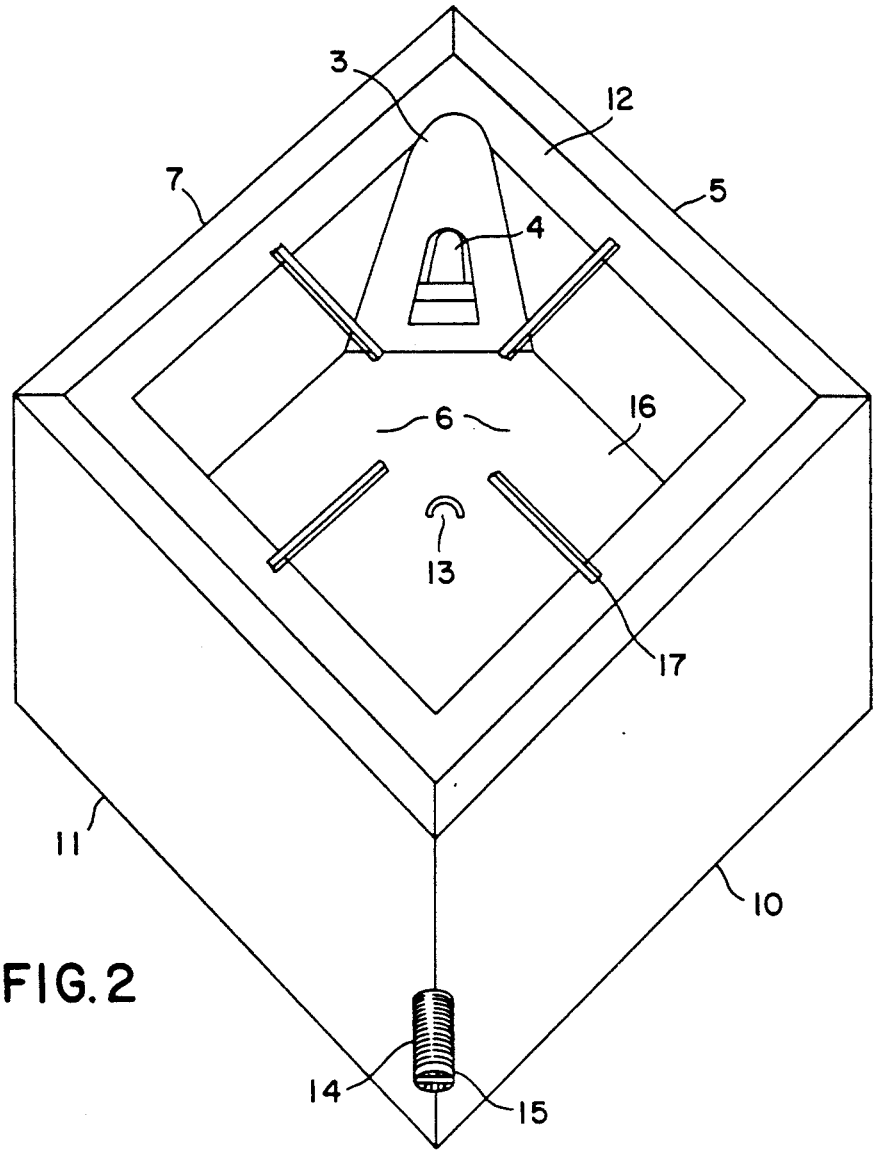
FIG. 2 is a top view of the target housing showing the inside three front panels and the vent in the sloped center triangular shaped panel. The four flexable fingers extend partly over the housing cavity. Also shown is the bottom panel and a loop secured to said bottom. In the rear corner of the target housing said corner formed by the two rearwardly angled perpendicular panels is shown a launch pin said launch pin having a slot in and across its diameter.

With reference to FIG. 1 one embodiment of the airborn archery target FIG. 2 is shown suspended from its parasail 8 as in flight. Parasail canopy 8 is a square piece of plastic film having a support line 9 attached to each corner of said canopy 8. Parasail canopy 8 with its support lines 9 is stored within the cavity 16 of the target housing FIG. 2 prior to launch.

With reference to FIG. 2 the main body of the target housing FIG. 2 is formed by placing six precut panels 3-5-6-7-10-11 of a soft plastic foam material of suitable dimensions and one end of the launch pin 1 in a compatable mold and injecting an expandable foam substance 12 into a crevice surrounding a male mold centrally located and suspended in the female mold containing the six soft plastic foam panels 3-5-6-7-10-11. Male mold has a release skin to which are attached the flexable fingers 17 with angled ends extending into the surrounding crevice so that the expandable foam substance 12 will rise and secure said flexable fingers 17 when said expandable foam substance 12 bond to soft plastic foam panels 3-5-6-7-10-11 while curing to a state of rigidity at which time the target housing FIG. 2 is removed from the molds and release skin and the vent 4 is formed in the sloped triangular front panel 3 and 12 by cutting a triangular shaped piece of bond plys of dissimilar foam materials 3 and 12 from the sloped front triangular shaped panel 3 thus allowing for passage of a stream of air through said vent 4 in the sloped front triangular shaped panel 3 and into the cavity 16. Launch pin 14 with slot 15 extends from the lower external corner formed by the rearwardly angled perpendicular panels 10-11. Opposite end of said launch pin 14 is imbedded in the rigid foam material 12 forming the bottom 6 of said cavity 16. Loop 13 is sewn through bottom panel 6 using a needle and suitable cord with said cord being knotted on the exterior of said bottom panel 6. Ends of parasail canopy 8 support lines 9 are attached to loop 13. Slot 15 in the end of launch pin 14 is the means for maintaining the correct position of the target housing FIG. 2 on the launch vehical during launch proceedings. Four flexable fingers 17 extending partly over the cavity 16 from the top perimeter of the four rigid foam 12 perpendicular walls of cavity 16 serve to contain the parasail canopy 8 and support lines 9 prior to deployment of same during launch.

While various changes may be made in the detail construction, it shall be understood that such changes shall be within the spirit and scope of the present invention as defined by the appended claims.

What I claim as new and desire to protect by letters Patent of the United States is:

1. An airborn archery target comprizing in combination; a two ply open topped housing, said housing having a cavity, said cavity having a rigid foam bottom and walls bonded to an external soft foam plastic covering, said housing having releasable means for holding captive within its cavity a parasail device, said releasable means allowing for the release of said parasail device from said cavity with assistance from air pressure through a vent in said housing's sloped front triangular shaped wall when said target is launched skyward by a launch vehical using a slotted launch pin externally located near the rear lower corner of said target housing.

2. The combination according to claim 1 where releasable means for containment and for allowing release of a parasail device from the target housing cavity, said releasable means being four flexable fingers extending partly over said cavity from the top perimeter of the target housing cavity's four rigid foam perpendicular walls.

3. The combination according to claim 2 whereby said target housing cavity serves to hold captive a parasail device with the aid of said overhead flexable fingers until said parasail device is ejected from said cavity by air pressure entering said cavity through said vent in the sloped forward triangular shaped wall of said target housing during launch proceedings.

4. The combination according to claim 3 where means for target housing being launched is a launch pin extending form the rear of the target housing said launch pin having a slot in and across the diameter of its external end, said slot used to maintain the correct position of the target housing on a self braking launch vehical during launch proceedings.

* * * * *